US008986183B2

(12) United States Patent
Monti

(10) Patent No.: US 8,986,183 B2
(45) Date of Patent: Mar. 24, 2015

(54) SYSTEM FOR TRANSFERRING TUBULAR BLANKS IN AN OPEN CONFIGURATION TO A SUPPLY LINE OF A PACKING MACHINE

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 722 days.

(21) Appl. No.: 13/272,785

(22) Filed: Oct. 13, 2011

(65) Prior Publication Data

US 2012/0094817 A1 Apr. 19, 2012

(30) Foreign Application Priority Data

Oct. 14, 2010 (IT) ..... BO2010A0613

(51) Int. Cl.

| | |
|---|---|
| ***B65B 43/12*** | (2006.01) |
| ***B65B 43/26*** | (2006.01) |
| ***B65B 43/18*** | (2006.01) |
| ***B65B 43/52*** | (2006.01) |

(52) U.S. Cl.

CPC ..... *B65B 43/265* (2013.01); *B31B 2201/289* (2013.01); *B31B 2203/003* (2013.01); *B65B 43/185* (2013.01); *B65B 43/52* (2013.01)

USPC ..... 493/315; 493/51; 493/318; 493/319; 493/162

(58) Field of Classification Search

CPC ..... B31B 1/78; B31B 1/80; B31B 3/00; B65B 43/12; B65B 43/24; B65B 43/26; B65H 5/16

USPC ..... 493/51, 55, 60, 64, 66–70, 309, 493/312–316, 424–426, 162, 318–319; 53/457, 458, 564, 566; 271/271

See application file for complete search history.

(56) References Cited

U.S. PATENT DOCUMENTS

| | | | | |
|---|---|---|---|---|
| 2,984,162 | A * | 5/1961 | Gordon | 493/310 |
| 5,415,615 | A * | 5/1995 | Culpepper | 493/315 |
| 5,473,868 | A * | 12/1995 | Antonio | 53/566 |
| 5,562,581 | A * | 10/1996 | Roberto et al. | 493/310 |
| 5,715,657 | A * | 2/1998 | Mondani et al. | 53/457 |
| 7,310,925 | B2 * | 12/2007 | Monti | 53/566 |
| 7,418,809 | B2 * | 9/2008 | Martelli | 53/564 |

FOREIGN PATENT DOCUMENTS

| | | |
|---|---|---|
| EP | 0669254 A | 8/1995 |
| EP | 0673834 A | 9/1995 |
| FR | 2478576 A | 9/1981 |

OTHER PUBLICATIONS

European Search Report for EP 2441689, Dated Feb. 20, 2012, 3 pages.

* cited by examiner

*Primary Examiner* — Thanh Truong
*Assistant Examiner* — Justin Citrin
(74) *Attorney, Agent, or Firm* — William J. Sapone; Ware Fressola; Maguire & Barber LLP

(57) ABSTRACT

A system for transferring tubular blanks to a packing machine includes an apparatus intermittently positioned in a zone (Z) situated in front of the line with an open tubular blank (150) hooked to a retainer (22). The apparatus includes a rotating member (510), activated in phase with the line movement, arranged between longitudinal walls (490), and having a series of transfer devices (525), angularly equidistanced along a circumference tangential to an upper line branch. The transfer devices have dynamic seating (460) for encountering in zone (Z), a tubular blank flap (1C). The tubular blank is freely inserted in the dynamic seating (460), and subsequently by hooking the seating, the transfer means are deactivated in proximity to the upper branch (470) in phase with the arranging of segments from radial to vertical first delimiting the dynamic seating (460) and a compartment (450) corresponding to the dynamic seating.

9 Claims, 6 Drawing Sheets

SYSTEM FOR TRANSFERRING TUBULAR BLANKS IN AN OPEN CONFIGURATION TO A SUPPLY LINE OF A PACKING MACHINE

FIELD OF THE INVENTION

Tubular blanks are known, in a flattened configuration, from which corresponding containers (for example boxes) are obtained.

To obtain these containers it is necessary to operate on the blanks with the aim of changing the configuration thereof, from flat to tubular, i.e. it is necessary to open out the blank.

The above function is performed by various apparatus.

DESCRIPTION OF THE PRIOR ART

A known type of apparatus consists of means acting to collect a bottom blank of a stack of blanks in a flattened tubular configuration, contained in a store, for transfer to a station of a series of stations located along a periphery of a drum set in constant rotation; these stations are identical and are angularly equidistanced.

Each of the stations is provided with retaining means that engage a first of two external flaps of each blank, and folding means acting on the remaining flap of the two external flaps in order to fold the remaining flap by at least ninety degrees with respect to the first (actually by more than 90° in order to compensate for the elastic return of the blank).

The blank, in open tubular configuration, is transferred onto a supply line, such as a type having compartments, of a packing machine which forms the bottom of the corresponding container, inserts predetermined articles via the open end of the container and lastly closes the open end by folding tabs hinged to the flaps of the blank.

This transfer (see FR 2,478,576) is implemented by an operating station constituted by a chain conveyor consisting of two equal and opposite chains, winding about two crown wheels, one a drive crown and the other a driven crown. These chains are connected to transversal support and guide rods for the corresponding sleds.

Each sled bears a transversal arm provided with suckers.

The sleds are subjected to the action of cams conformed such as to move the sleds transversally in suitable phase relation with the movement of the chains.

The positioning of the suckers, borne by the relative transversal arm, is such as to define two end positions.

In a first end position, which occurs when the arm is moving along the curved portion of the transporter (arranged in front of the above-mentioned drum), the suckers intercept a flap of the open tube, situated in a station of the drum; the activation of the suckers in phase relation with the deactivation of the retaining suckers of the station, cause the blank to transfer to the suckers of the arm.

Thereafter, the arm describes a portion of circular trajectory and is then subjected to a longitudinal motion, with a velocity that is equal to that of the above-mentioned compartmented line, and to a horizontal motion towards the compartments such as to introduce the opened-out blank into a compartment (second end position of the suckers of the arm).

At this point, the suckers are deactivated and the arm translates transversally in the opposite direction to the previous one.

Abutting means are provided for maintaining the blank opened out up to when it is introduced into the relative compartment.

A drawback of the aforementioned operating station is connected with the fact that it is necessary to move the drum, in suitable phase relationship, for opening the blank out, as well as the chains that carry the blanks and the line bearing the crates.

Further drawbacks derive from the complexity of the work station, in particular the conformation of the cams operating the sleds, due to the fact that the sleds projectingly support the arms and also due to the fact that fixed abutments are comprised in order to keep the blanks opened out. This problem is exacerbated when the format has to be changed.

The work station is arranged flanked to the supply line and develops mostly at a lower height than the line: this leads to a corresponding large overall transversal size of the whole apparatus (i.e. rotating drum and work station) and of the packing machine.

The main aim of the present invention is to obviate the above drawback, and in particular to disclose a system implementing the transfer of blanks in an open tubular configuration directly from the drum to the supply line of a packing machine.

A further aim of the invention is to provide a system which enables intervening on the drum, and on the supply means thereto of the tubular blanks in the flattened configuration, such as to streamline and simplify the change-format operation of the blanks.

SUMMARY OF THE INVENTION

The main aim is attained in accordance with the present invention is achieved by a system for transferring tubular blanks in an open configuration to a supply line of a packing machine, the line being constituted by belts loop-wound on at least two crown wheels, a drive wheel and a driven wheel, to which belts an abutting segment and a thrust segment are perpendicularly fixed, alternatively from downstream to upstream, facing externally so as to define at an upper branch of the line, at which the abutting segment and the thrust segment are vertical, equidistanced compartments, the segments identifying, in a curved tract located upstream of the upper branch, in which the segments are radial with respect to an axis of the relative crown of the crowns, dynamic seatings a dimension of which in a motion direction of the line is greater than a dimension thereof of a corresponding compartment. The system comprises an apparatus destined to position a tubular blank in an open configuration intermittently in a zone situated in front of the head of the line defining the curved tract, the tubular blank being hooked to relative retaining means; a rotating member, activated in phase relation with a movement of the belts, arranged between the longitudinal walls of the line at the head, coaxial with the crown relative thereto, and provided with a series of transfer means which are angularly equidistanced along a circumference tangential to the upper branch, the transfer means involving, in the tract facing towards the head, a corresponding dynamic seating for encountering, in the zone, a flap of the tubular blank, the tubular blank being freely inserted in the dynamic seating, and subsequently hooking it consequently of the activation of the transfer means actuated in phase relation with a deactivation of the retaining means, the transfer means being deactivated in proximity of the upper branch in phase relation with the arranging from radial to vertical of the abutting segment and the thrust segment first delimiting the dynamic seating and finally the compartment corresponding to the dynamic seating, which by means of the segments retains the tubular blank and establishes the open tubular conformation thereof.

The apparatus is preferably defined by: a store containing a stack of tubular blanks destined to hook the first flap of the two external flaps of the base blank of the stack; a drum rotating with respect to an axis that is parallel to the rotation axis of the rotating member, peripherally exhibiting angularly-equidistanced work stations transiting intermittently in the zone, each of the stations being provided with retaining means destined to receive, from the pick-up means, upstream of the zone, the first flap of the blank picked up from the base of the stack and to hook the first flap following activation of the retaining means actuated in phase relation with a deactivation of the pick-up means, each of the work stations being provided with folding means rotating in an opposite direction to the rotation direction of the drum in order to intercept the second flap of the two external flaps with a consequent rotation of the flap about the score-line connecting the two external flaps to define the open tubular configuration of the blank.

The transfer of the tubular blank in an open configuration from the drum to the upper supply branch of the supply line of the packing machine will be actuated by means of the rotating member which is coaxial to the head of the line facing towards the drum and positioned internally of the longitudinal walls of the line; this technical-functional aspect simplifies the phase relation between the work stations of the drum and the line, and also does not involve occupying additional space as the rotating member does not exceed the dimensions of the line.

Abutting means are not required to prevent the flattening of the blank during transfer thereof into the crates of the line.

A further advantage is achieved where the apparatus is supported by a structure which can translate in a direction defined by the line joining the axes respectively of the drum and the rotating member, enabling transit into the zone of the work stations on varying a format of the tubular blanks.

On varying the format, it is sufficient to translate the structure bearing the apparatus: this enables non-intervention on the two reference planes of the system of the invention, of which one relates to the "opening-out" of the blank and the other to the supply line.

BRIEF DESCRIPTION OF THE DRAWINGS

Further characteristics of the invention will emerge from the following description, which makes reference to the accompanying figures of the drawings, in which.

DESCRIPTION OF THE PREFERRED EMBODIMENTS

Figure 1:
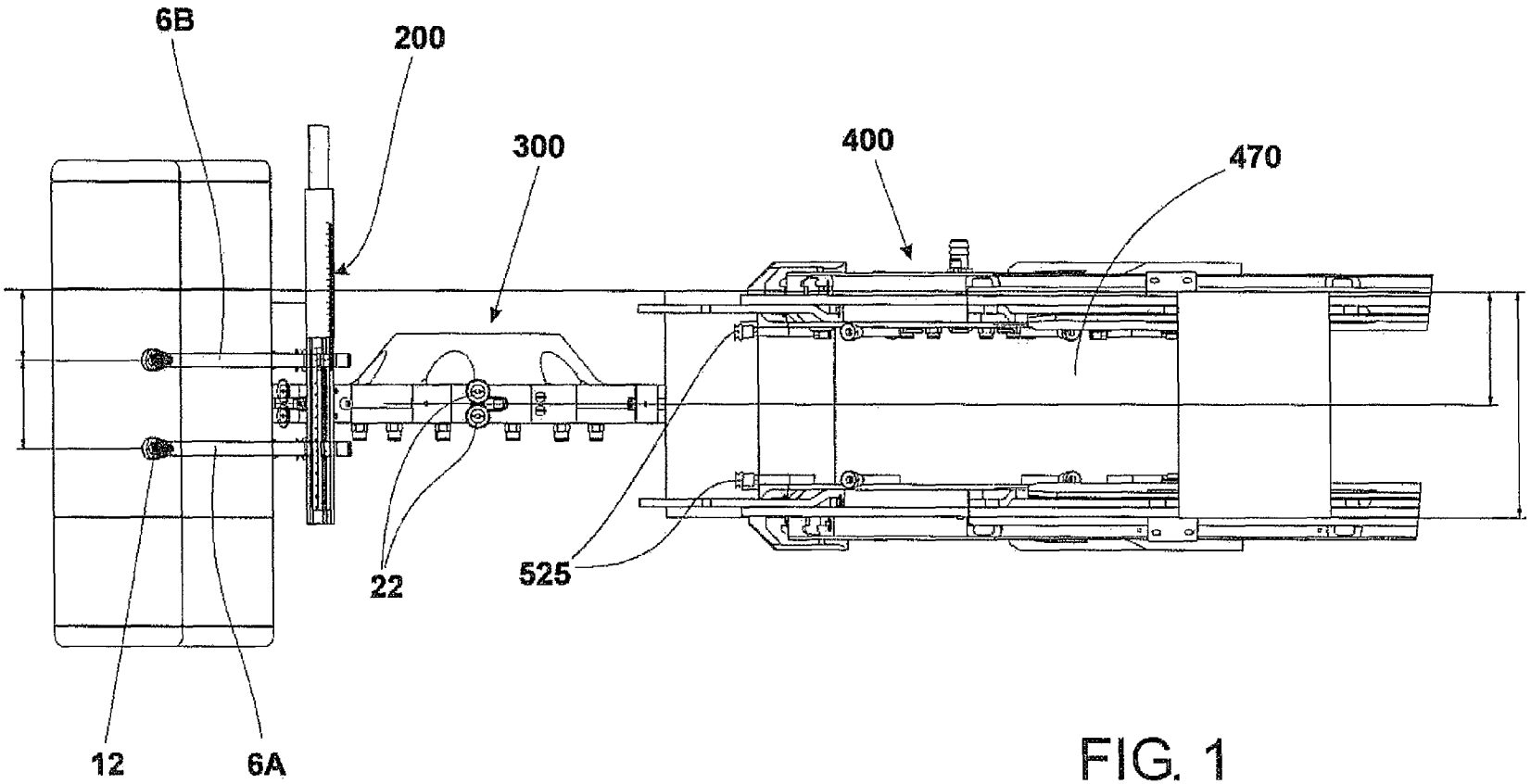
FIG. 1 is a view from above of the system of the invention.
Figure 2A:
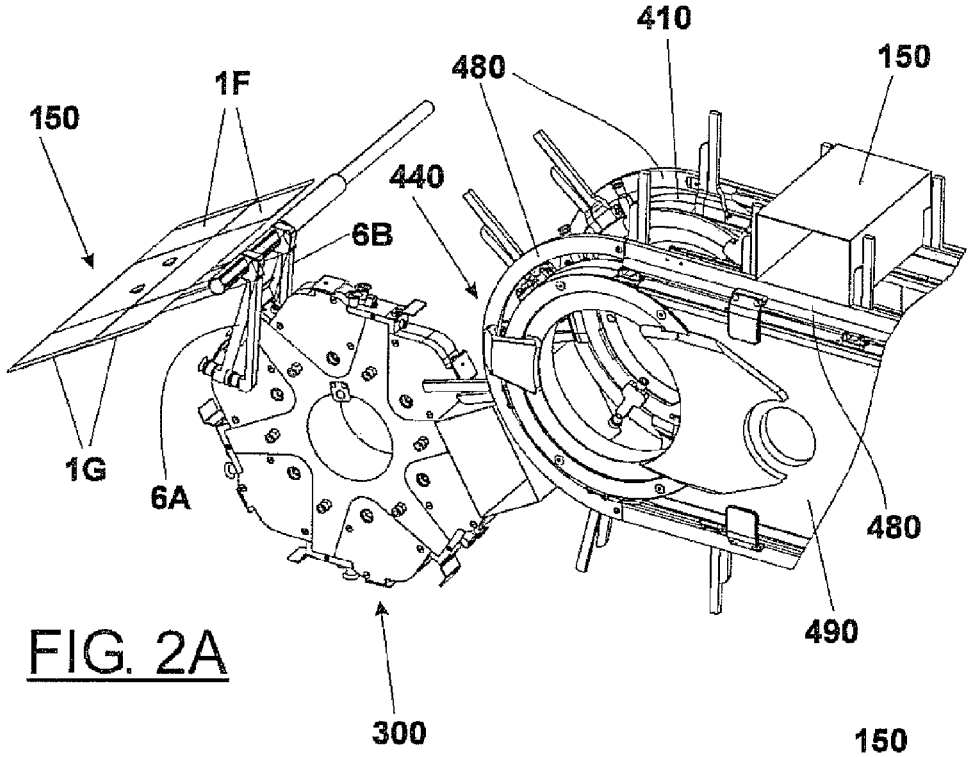
FIGS. 2A, 2B are perspective views from different angles, of the system of FIG. 1.
Figure 2B:
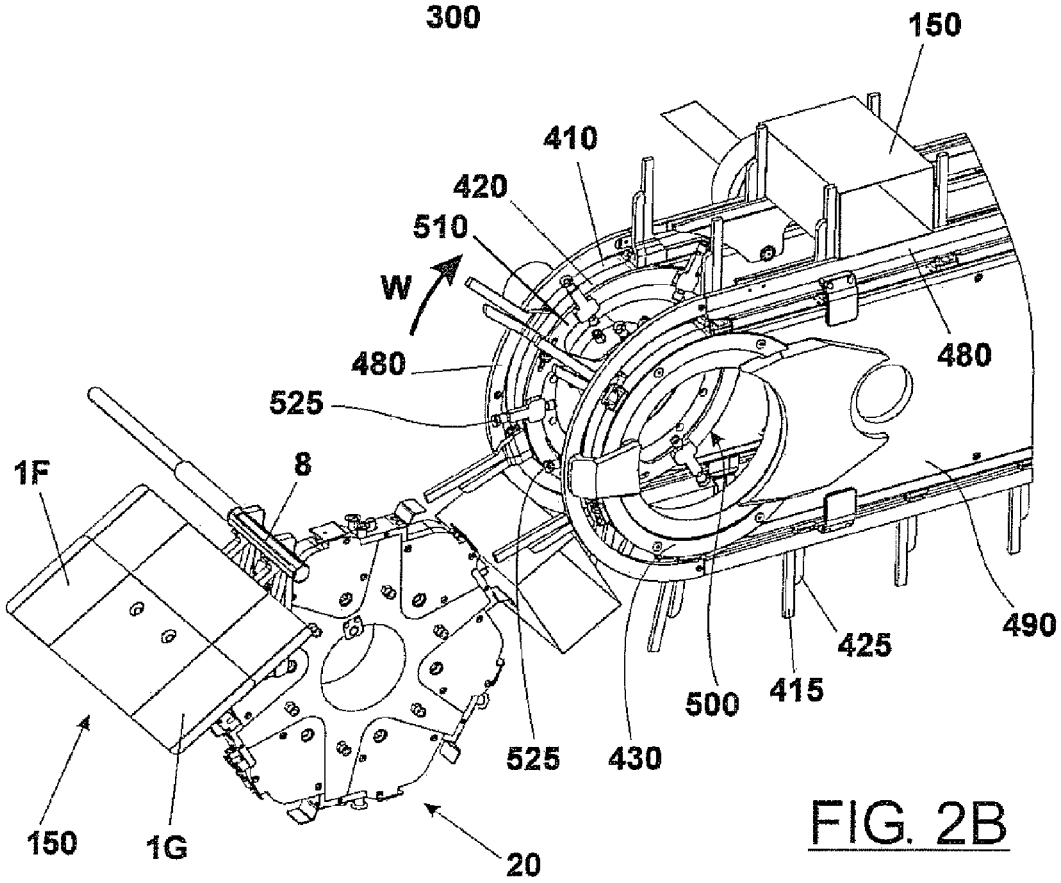

It is known that a tubular blank 150 is constituted by four consecutive flaps connected by score-lines 1A-1D 2A-2D, which behave as hinges. Tabs 1F, 1G only illustrated in FIGS. 2A, 2B are hinged to the heads of the other flaps, by means of relative score-lines.

In the remaining figures these tabs are not represented with the aim of making the technical and functional aspects of the invention clear.

With reference to the figures, 100, 200, 300, 400 respectively denote: a store containing a stack P of blanks 150 in a tubular flattened configuration; first means for removing the blank at the bottom of the stack; a drum 300 kept in constant rotation in a direction F, peripherally interested by work stations 20, identical to one another and angularly equidistanced, each of which is destined to receive, and retain, a blank 150 supplied thereto by the first means; a supply line of crates 450 of which the head facing the drum 300 has been illustrated.

With the blank in the flattened configuration, the flaps 1A-1D are distributed according to an external plane (flaps 1A, 1B) and an internal plane (flaps 1C, 1D); the internal flaps are connected by the score-line 2A.

Figure 3A:
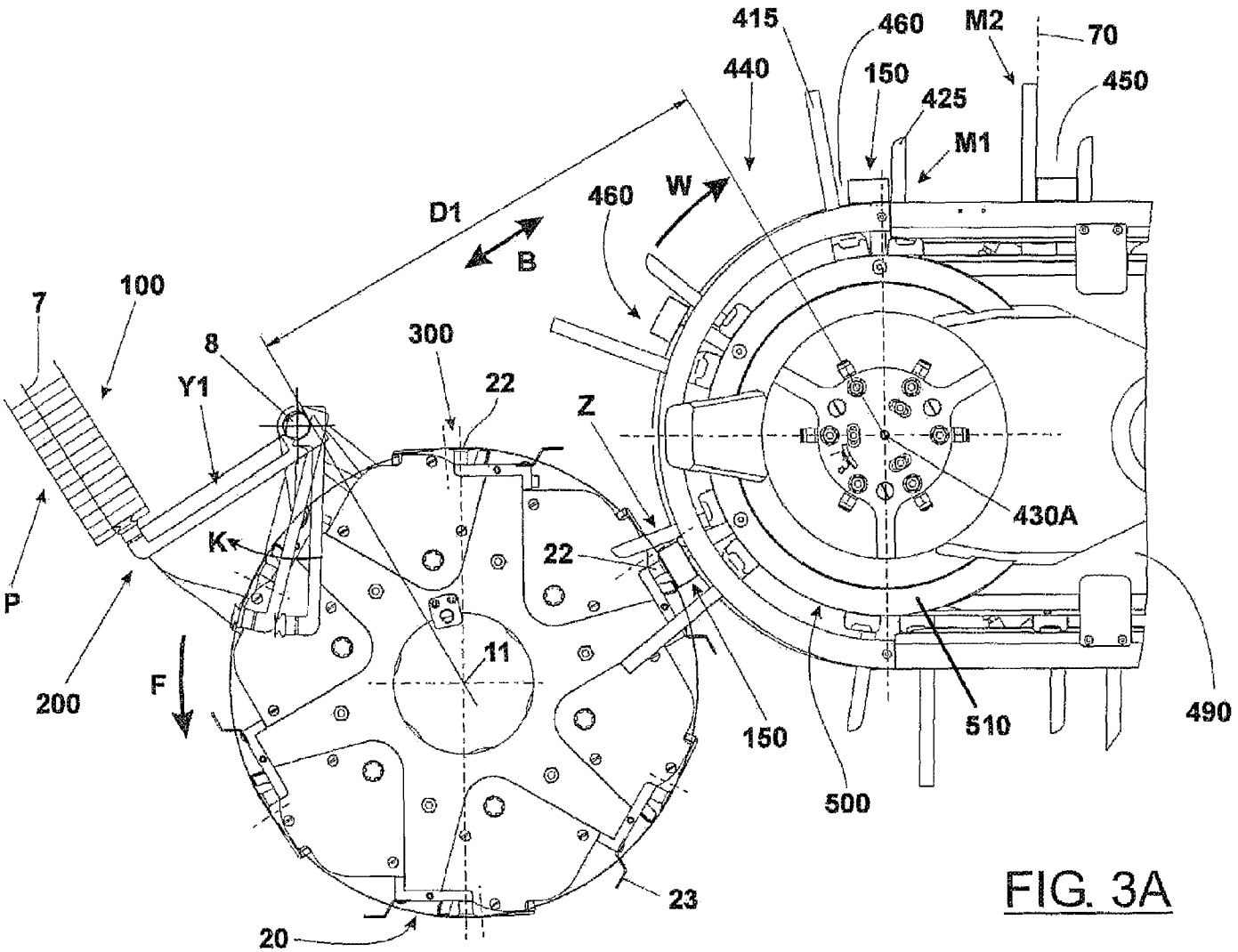
FIGS. 3A, 3B are front views of the system of the invention, respectively relating to two different blank formats.
Figure 3B:
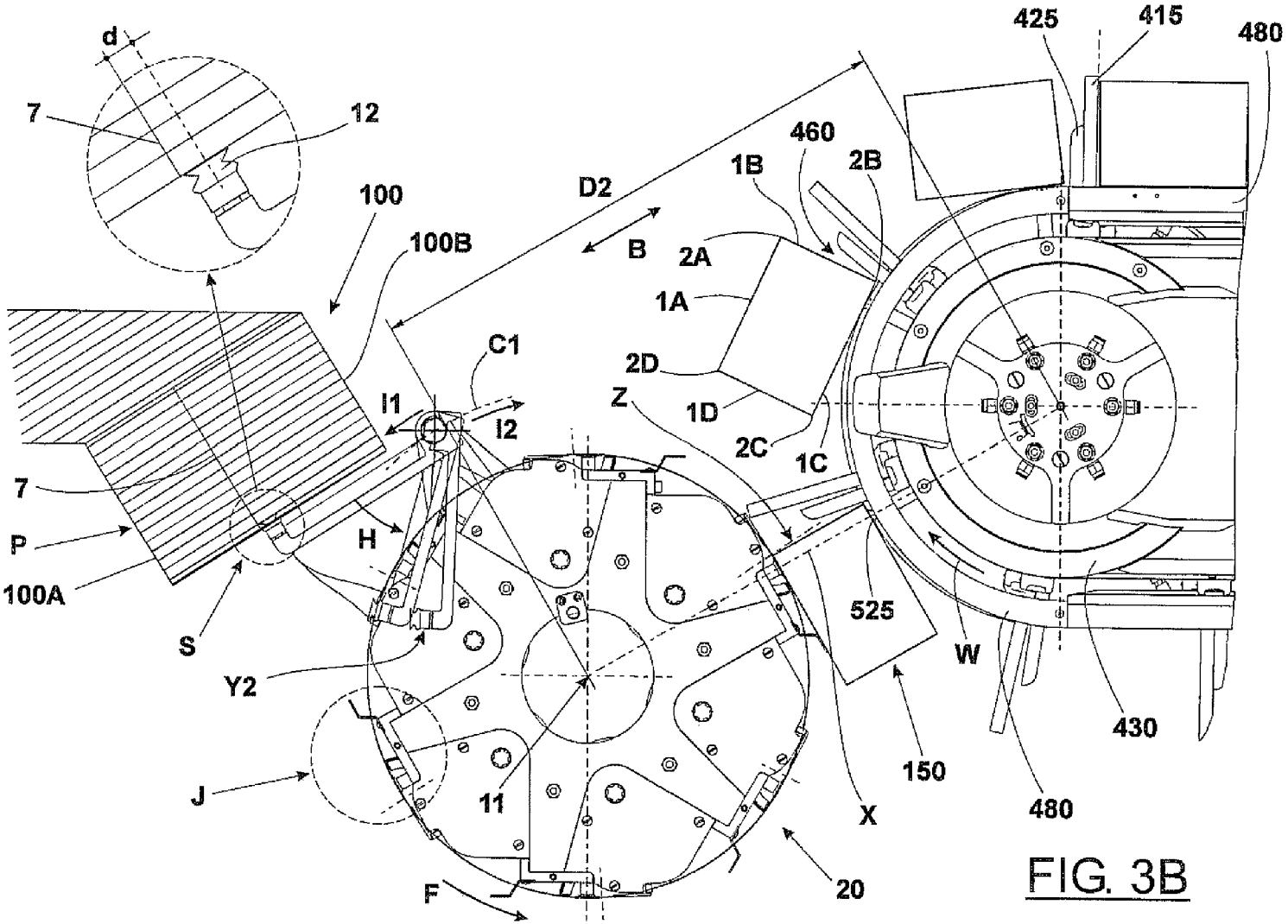

The walls 100A, 100B of the store are mutually positioned such as to have the score-lines 2A of the blanks of the stack P arranged along a plane 7 (first reference plane); this is satisfied independently of the format of the blanks (see FIGS. 3A, 3B relating, for example, to the maximum and minimum format).

The first means 200 are constituted by a flanked pair of arms 6A, 6B splined on a shaft 8 made to oscillate in an outward and a return run H and K; if necessary the shaft 8 is made to oscillate by synchronizing means, along an arc of circumference C1, coaxial with the shaft 11 of the drum 300, in operating directions $C_1$, and a non-operating direction $I_2$.

The arms, the mutual distance between which is greater than the thickness of the drum 300, are positioned so as to be arranged at the end of the outward run, bilaterally with respect to the heads of the drum itself.

Each station 20 of the drum 300 is provided with two retaining suckers 22 transversally flanked, i.e. in a direction parallel to the axis of the drum 11; a plate 23 is provided upstream of the suckers 22, aligned with the plane defined by the suckers.

The station further comprises, in an internal position with respect to suckers 22, a portion of the crown wheel 27 that externally enmeshes with a rotating mechanism 25 and is internally supported and guided by idle rollers 28 the axes of which are parallel to the axis C of the crown wheel; the axis C is located downstream (with reference to the direction F of the drum rotation) with respect to the suckers 22 and the plane identified by said suckers 22.

The distance between the axis C of the crown wheel and the plane identified by the axes of the suckers 22 is a predetermined value d.

At an end thereof, the crown 27 bears folding means 29 orientated inwardly according to a diameter plane of the crown wheel which, as a result of the oscillation, oscillates about the axis C.

In the end position Y1, the suckers 12 borne by the arms 6A, 6B intercept the first flap 1A of the two external flaps of the bottom blank from the stack P; the arms are conformed and positioned such that the distance in this position between the reference plane 7 and the plane identified by the axes thereof 12 borne at the free ends of the arms is equal to the above-mentioned predetermined value d (see enlarged detail S of FIG. 3B) which is maintained when the blank format is varied.

The oscillation of the arms in the outward run H enables transfer of the attached blank from the suckers 12 to a corresponding work station 20.

The mutual phase relationship between the oscillation of the arms and the velocity of the drum 300 is such as to place the pick-up suckers transversally flanked to the station, which causes the impact of the first flap 1A against the retaining suckers 22.

In phase relation with this impact the pick-up suckers 12 are deactivated and the retaining suckers 22 activated.

To avoid stress to the external surface 1A of the first flap 1A, the shaft 8 is moved in the operational direction 11, such as to impose, at least at the moment of impact, a peripheral velocity of the pick-up suction device 12 that is equal to the peripheral velocity of the retaining suckers 22.

Following the disengaging of the suckers 12 from the first flap 1A, the arms continue forward in the outward run up until reaching the end position Y2 (FIGS. 3A, 3B): this enables them to make the return run without interfering with the blank drawn in the direction F by the retaining suckers 22.

At the moment of impact of the first flap 1A on the retaining suckers 22, the planes defined by the axes of the pick-up suckers 12 and the retaining suckers 22 coincide: it follows that the score-line 2A connecting the external flaps 1A, 1B is arranged along the axis C.

In phase relation with the engaging of the first flap 1A by the suckers 22, the rotating mechanism 25 imposes the oscillation of the crown wheel 27 in the direction Q, with a consequent oscillation of the folding means 29, with respect to the axis C, in the opposite direction to the direction F of rotation of the drum.

The folding means 29 intercept the second flap 1B of the external flaps 1A, 1B of the blank, causing it to oscillate about the score-line 2A thereof (i.e. swing around the axis C) by at least 90°; in reality this angle is exceeded (position N in FIG. 4) in order to prevent the elastic return of the score-lines 2A-2D when the folding means cease the action thereof.

Figure 4:
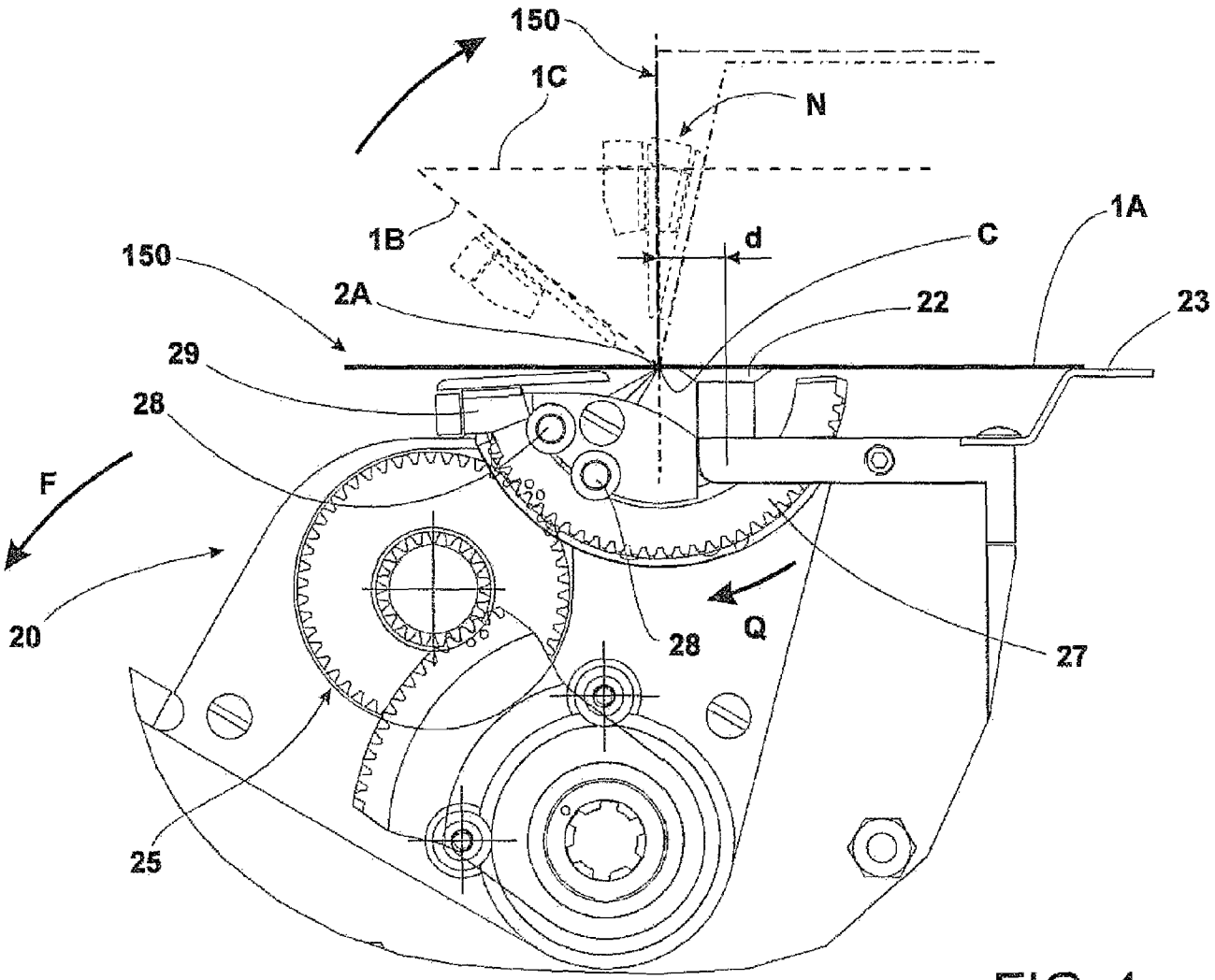
FIG. 4 illustrates, in enlarged scale, the detail J of FIG. 3B, with parts removed and others (not shown in FIG. 3B) highlighted such as to focus on technical and functional aspects.

FIG. 4 shows that the first flap 1A is resting on the plate 23: this helps to stabilize the flap during the opening-out of the blank, consequent to the rotation of the second flap 1B with respect to the score-line 2A.

The combined action of the retaining suckers 22 and the folding means 29 enables obtaining the configuration of the opened-out tubular blank 150 as shown in FIGS. 3A, 3B; this configuration is maintained up to a release zone Z in which the station 20 functionally cooperates with a device 500 for transferring the tubular blank 150 from the station to a crate 450 of the upper branch 470 of the supply line 400.

The line 400 is constituted, in a known way, by a first pair of identical belts 410, arranged facing on vertical planes, winding in a closed loop on crown wheels, a drive wheel and a driven wheel, of which only the driven wheels 430 are illustrated; the axis 430A of the crown wheels is parallel to the axis 11 of the drum 300.

The ends of the first segments 415 facing outward are perpendicularly solidly constrained to the belts, with each segment being transversally flanked to a corresponding segment of the remaining belt such as to define pairs of thrust segments 415; at the upper branch of the said pair of belts, the front surfaces of these segments define a second reference plane 70, or reference plane for the tubular blank 150.

The line 400 comprises a second pair of identical belts 420, correspondingly adjacent to the preceding belts 410 and developing similarly thereto, with respect to which they are operated in synchrony, according to known techniques.

Second segments 425 facing outward are perpendicularly solidly constrained to the second pair of belts; in this way pairs of abutting segments 425 are defined.

The distance between the pair of abutting segments 425 and the pair of thrust segments 415, arranged upstream of the abutting segments 425, identify, at the upper branch 470 of the line 400, a corresponding crate 450.

According to known techniques, the first and second pairs of belts are operated in a staggered way: for example, FIGS. 3A, 3B relate to the minimum and maximum size of the crate, that is, the minimum and maximum size of the tubular blank 150.

The device 500 is constituted by a rotating member 510 arranged between the longitudinal walls 490 of the line 400 at the head 440 thereof situated opposite the zone Z; this member is coaxial with the crowns 430 of the head and is conformed and positioned such as not to interfere either with the belts 410, 420 or with the segments 415, 425 borne thereby.

The rotating member 510, for example constituted by a drum or a facing pair of discs, solidly constrained to each other, peripherally bear second pick-up means, constituted for example by pairs of transfer suckers 525 (connected to a vacuum source, not illustrated) angularly equidistanced along the periphery of the rotating member 510; the transfer suckers 525 of each pair are transversally flanked, i.e. arranged in a diameter plane of the rotating means.

The transfer suckers describe a circular trajectory tangential to the upper branch 470 of the line 400.

Figure 5:
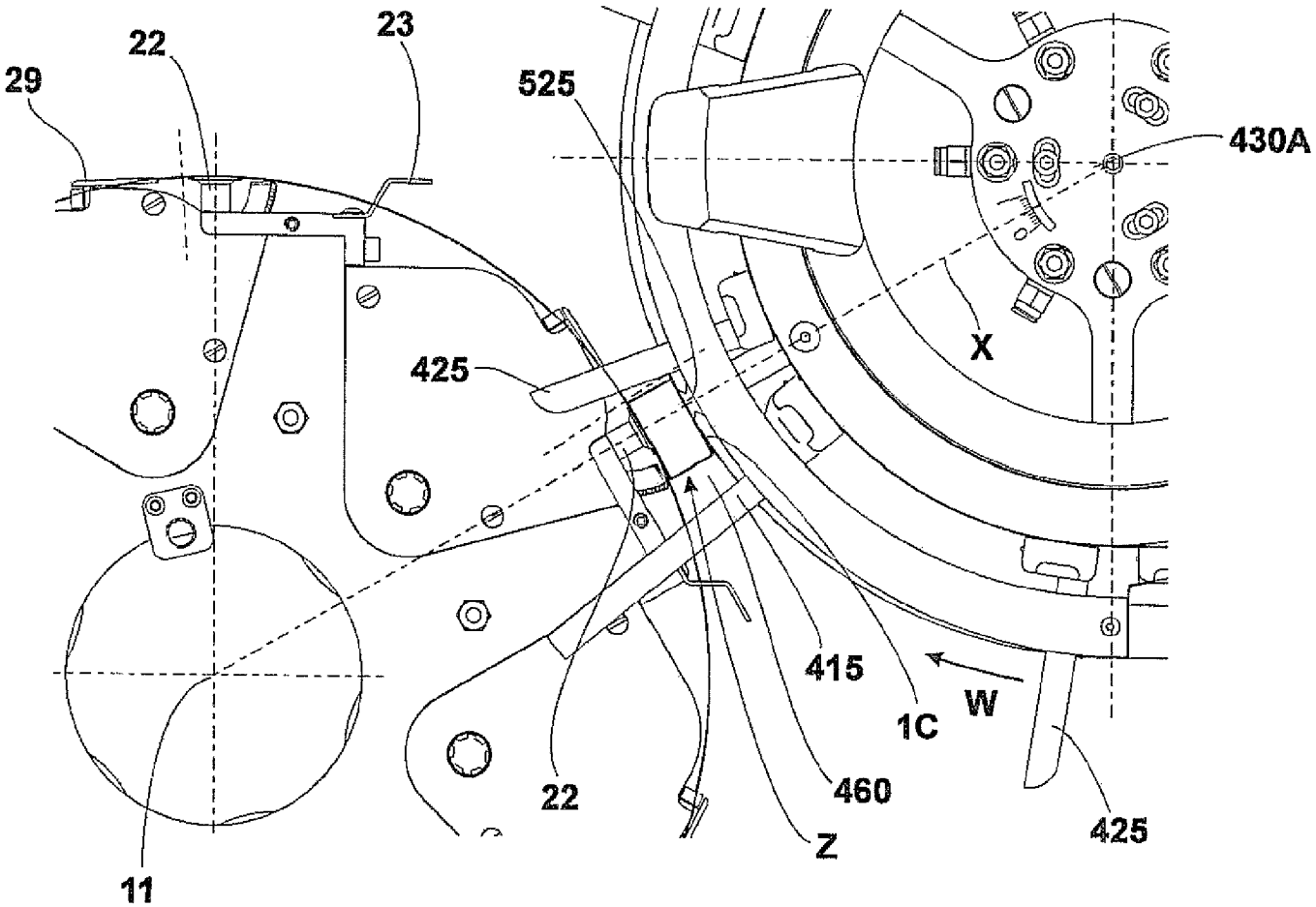
FIG. 5 illustrates, in enlarged scale, zone Z of FIG. 3A.

As is known, the segments 415, 425 are vertical at the upper branch 470, such as to define the volume of the crate 450 identified thereby; when the belts cross the crown wheels located upstream of the upper branch 470, the segments are arranged radially such as define there-between a housing, a minimum distance of which, in the rotation direction W of the rotation of the crowns themselves, is greater than the size, in the same direction, of the tubular blank 150 (see FIGS. 3A, 3B, 5).

The rotating member 510, in following the pathway facing towards the head 440, positions a pair of transferring suckers 525 in a corresponding transfer dynamic seating 460.

The mutual phase relation between the movements of the drum 300 and the rotating member 510 are such that the retaining suckers 22 in the station 20 and the transfer suckers 525 of the rotating member 510 are arranged aligned on a same plane X that is diametral both for the drum 300 and for the rotating member 510. In this situation the suckers 525 intercept the external flap 1C parallel to the first flap 1A.

In phase relation with the alignment, the folding means 29 disengage from the second flap 1B, the retaining suckers 22 deactivate and the transfer suckers 525 activate.

The abutting segments 425 delimiting the dynamic seating 460 downstream are positioned relative to the suckers 525 in such a way as to counter the closure, due to elastic return, of the tubular blank 150.

The dynamic seating 460 in which the tubular blank 150 hooked, with its flap 1C, to the transfer suckers 525, maintains the spatial configuration thereof, not necessarily having a rectangular section, up to when the contrast segments 425, from being radial, become arranged vertical at the start of the upper branch 470 of the line 400 (position M1 in FIG. 3A): at this point the size of the seating 460 in the direction W gradually decreases and then stabilizes as the segments 415 have also changed from radial to vertical up to defining the volume of the crate 450 (M2 position of FIG. 3A).

The deactivation of the transfer suckers 525 occurs in phase relation with the above position, and in practice before it, such as to avoid stress on the flap 1C when placing the tubular blank 150 between the thrust segments 415 and the abutting segments 425.

During the transfer of the blank tube 150 from the zone Z up to the upper branch 470 of the line, the flap 1C is abutted by small lateral walls 480, first curved (FIGS. 2A, 2B) and then straight: in the curved tract the flap is tangential of the walls (FIG. 3B), then to go to rest thereof in the straight tract, i.e. in the upper branch.

The above-described small walls contribute to stabilizing the blank tube 150.

Subsequently, in a known way in the packing machine, not illustrated, the flaps 1G are folded to define the bottom of a corresponding container, articles are placed therein, and finally the remaining flaps 1G are folded to realize the cover of the container.

With regard to the change of format, note that the two considered reference planes 7, 70 must be respected.

In particular the format change is performed as now described.

With regard to the first reference plane 7, the mutual distance between the walls 100A, 1008 of the store 100 is varied, such that the plane 7 on which the score-lines 2A of the flattened blanks 150 are arranged at distance d with respect to the plane identified by the collecting suckers 12 when they intercept the first flap 1A of the bottom blank in the stack: the mutual positioning between the bottom of the stack P of blanks, the first means 200 and the drum 300 is maintained.

As regards the second reference plane 70, which is crucial for the filling and closing operations of the container (corresponding to the tubular blank 150) carried out by the above-described packing machine, which presupposes not modifying the positioning of the line in any way with respect to the machine, it is necessary to consider that on varying the format, the distance between the axes 11, 430A, respectively of the drum and the crown wheels 430 of the line 400 also necessarily varies: see FIGS. 3A, 3B, where this distance is indicated by D1 (minimum format FIG. 3A) and D2 (maximum format FIG. 3B).

For the above reasons, the apparatus constituted by the store 100, the first means 200 and the drum 300, is borne by a same structure (not shown) that can translate in the direction B defined by the line which connects the axes 11, 430A, along a tract that is at least equal to the difference between D2 and D1.

The above description has considered a particular embodiment of the drum 300, the work stations of which intervene to vary the shape of the blank from flattened to tubular without causing lacerations and/or scoring and/or creasing and/or stress on the second flap 1B, which is the one subjected to the action of the folding means.

The ambit of protection of the invention is understood to extend independently of the modes with the blank is opened out.

The invention claimed is:

1. A system for transferring tubular blanks in an open configuration to a supply line of a packing machine, the line being constituted by belts loop-wound on at least two crown wheels, a drive wheel and a driven wheel, to which belts an abutting segment and a thrust segment are perpendicularly fixed, alternatively from downstream to upstream, facing externally so as to define at an upper branch of the line, at which the abutting segment and the thrust segment are vertical, equidistanced compartments, the segments identifying, in a curved tract located upstream of the upper branch, in which the segments are radial with respect to an axis of the relative crown wheel, dynamic seatings, a dimension of which in a motion direction of the line is greater than a dimension thereof of a corresponding compartment, the system comprising:

an apparatus for positioning a tubular blank in an open configuration intermittently in a zone situated in front of a head of the line defining the curved tract, the tubular blank being hooked to relative retaining means;

a rotating member, activated in phase relation with a movement of the belts, arranged between longitudinal walls of the line at the head, coaxial with the crown wheel relative thereto, and provided with a series of transfer means which are angularly equidistanced, the transfer means having, in the tract facing towards the head, a corresponding dynamic seating for encountering, in the zone, a flap of the tubular blank, the tubular blank being freely inserted in the dynamic seating, and subsequently hooking the dynamic seating, as a consequence of activation of the transfer means which are actuated in phase relation with a deactivation of the retaining means, the transfer means being deactivated in proximity of the upper branch in phase relation with the arranging from radial to vertical of the abutting segment and the thrust segment delimiting the dynamic seating and the compartment corresponding to the dynamic seating, which, by the segments, retains the tubular blank and establishes an open tubular configuration thereof;

the transfer means being positioned along a circumference tangential to the upper branch;

a drum rotating with respect to an axis that is parallel to a rotation axis of the rotating member, peripherally exhibiting angularly-equidistanced work stations, each of the work stations being provided with retaining means;

the drum being supported by a structure for translating the drum in a direction defined by a line joining axes respectively of the drum and the rotating member, enabling transit into the zone of the work stations upon a varying of a format of the tubular blanks;

movements of the drum and the rotating member being such that, in the zone, the retaining means of a work station transiting said zone and the transfer means of the rotating member are arranged aligned on a same plane that is diametral both for the drum and for the rotating member.

2. The system of claim 1, wherein at least the head laterally exhibits curved walls, developing along an arc of circumference which is coaxial to the rotation axis of the rotating member configured to encounter the flap hooked to the transfer means during the transfer of the tubular blank from the zone to a corresponding compartment of the upper branch of the line.

3. The system of claim 1, further comprising:

a store containing a stack of tubular blanks which hooks a first flap of two external flaps of a base blank of the stack in which the work stations transiting intermittently in the zone and in which the retaining means of each work station are adapted to receive, from a pick-up means, upstream of the zone, the first flap of the blank picked up from the base of the stack and to hook the first flap following activation of the retaining means actuated in phase relation with a deactivation of the pick-up means, each of the work stations being provided with folding means rotating in an opposite direction to the rotation direction of the drum in order to intercept a second flap of the two external flaps with a consequent rotation of the second flap about a score-line connecting the two external flaps to define the open tubular configuration of the blank.

4. The system of claim 3, wherein walls of the store are reciprocally positioned so as to position the score-line connecting the two external flaps in a first reference plane, wherein first pick-up means are constituted by pick-up suckers borne at ends of at least two arms, remaining ends of which are keyed on a shaft, parallel to the drum axis, being oscillated with respect to the axis thereof so as to define, for the arms, a first position in which the suckers hook to the first flap of the base blank at a predetermined distance with respect to the reference plane, and a second position in which the first flap abuts the retaining means with the score line positioned on an axis, situated downstream of the retaining means, parallel to the rotation axis of the drum, and wherein the folding means are made to oscillate about the axis by activating means thereof.

5. The system of claim 4, wherein the activating means are constituted by a portion of a circular crown, an axis of which coincides with said axis and which enmeshes with a rotating mechanism, supported and guided in an internal side by idle rollers parallel to the crown axis, the folding means being fixed at an end of the crown and orientated inwardly along a diameter plane of the crown.

6. The system of claim 4, further comprising synchronization means for oscillating the axis with respect to the rotation axis of the drum between an operating direction and an non-operating direction, the operating direction being equal to the drum rotation direction, defining a peripheral velocity of the pick-up suckers at a moment of impact of the first flap with the retaining means which is equal to a peripheral velocity of the retaining means.

7. The system of claim 3, wherein the retaining means are constituted by at least one aspirating sucker, an axis of which is distanced, with respect to said axis about which the folding means rotate, by an amount equal to a predetermined value.

8. The system of claim 3, wherein the transfer means hook a flap opposite the first flap attached to the retaining means.

9. The system of claim 1, wherein the transfer means are constituted by a same number of aspirating suckers borne radially by the rotating member.

* * * * *